US005415121A

United States Patent [19]

Corlett

[11] Patent Number: 5,415,121

[45] Date of Patent: May 16, 1995

[54] AIR FLOW INDICATOR FOR SAILBOAT SAILS

[76] Inventor: Edwin H. Corlett, 607 N. Grove Ave., Oak Park, Ill. 60302

[21] Appl. No.: 303,727

[22] Filed: Sep. 9, 1994

[51] Int. Cl.[6] ..... B63H 9/04

[52] U.S. Cl. ..... 114/102; 114/39.001

[58] Field of Search ..... 116/265; 114/102, 103, 114/39.1; 73/170.05, 170.02, 170.03

[56] References Cited

U.S. PATENT DOCUMENTS

| | | | |
|---|---|---|---|
| 3,789,793 | 2/1974 | Keim | 114/102 |
| 3,815,412 | 6/1974 | Keim | 73/170.03 |
| 4,223,631 | 9/1980 | Pood | 114/103 |

*Primary Examiner*—Edwin L. Swinehart

[57] ABSTRACT

An air flow indicator for a sailboat sail has a lever passing through a small hole in the surface of the sail. Flexible tails are affixed to opposite ends of the lever on opposite sides of the sail. The lever is so configured as to remain centered with respect to the sail. Unequal air flow on opposite sides of the sail cause unequal forces on the flexible tails causing the lever to pivot with respect to the sail. The pivoting of the lever with respect to the sail is observable while viewing only one side of the sail which allows the viewer to determine the air flow conditions on both sides of a sailboat sail while viewing only one side.

5 Claims, 2 Drawing Sheets

AIR FLOW INDICATOR FOR SAILBOAT SAILS

BACKGROUND OF THE INVENTION

1. Field of the Invention

The invention relates to sailboat sails and more particularly, to a device that indicates whether the air flow on a sail is attached to the leeward side, windward side or both sides of the sail while viewed from only one side of the sail.

2. Description of the Prior Art

Sailors desiring maximum efficiency from their sails use flexible tails, often called tell-tales, as indicators of sail trim. These flexible tails are pieces of light weight yarn or ribbon attached to the sail by one end and allowed to stream aft with the air flow on the sail. If the air flow is attached, the flexible tail streams aft indicating the most efficient trim of the sail. If the air flow is not attached but turbulent, the flexible tail lifts upward or points forward indicating inefficient sail trim. This requires that a flexible tail on both sides of the sail be observed at the same time while the observer can only see one side of the sail. The common solution to this problem is to try and observe the shadow of the leeward flexible tail against the sail but this only works when the light conditions are suitable. Another solution is to install a clear plastic window in the sail where the flexible tails are placed so that both flexible tails can be seen at once but this is an added expense. Another major problem with flexible tails is that if they become wet, they stick to the sail and are useless. This invention solves the aforementioned problems.

SUMMARY OF THE INVENTION

The invention provides an air flow indicator for use on sailboat sails. It allows the sailor, while viewing only one side of the sail, to tell when the air flow on either or both of the sail surfaces is attached (non-turbulent). It is a simple device which is easily installed anywhere on the sail surface and does not need a window in the sail. Its performance is not appreciably effected by rain or wet sails.

The device uses the same principle as the flexible tail, commonly called tell-tale, that is attached directly to the sail surface and indicates attached air flow when streaming aft and turbulent air flow when pointing up or forward. This device, however, does not attach the flexible tails directly to the sail surface but instead to opposite ends of a lever that passes through a small hole in the sail surface that is easily made with a needle. The lever is designed so that it protrudes equally from each side of the sail and is free to pivot with respect to the sail surface. The angular position of the lever with respect to the sail surface is now controlled by the forces exerted by the flexible tails at each of the lever ends. If the forces are equal, attached air flow on both sides of the sail, the lever assumes a middle position with respect to the sail surface. If the forces are unequal, attached air flow on one side of the sail and turbulent air flow on the other side of the sail, the lever assumes one of two extreme angular positions with respect to the sail surface depending on which flexible tail exerts the greatest force. The positioning of the lever by the interaction of the two flexible tails allows the sailor to determine the type of air flow on both sides of the sail while only viewing from one side. An added feature is the reduced tendency to not stick to a wet sail because the lever holds the flexible tails away from the sail surface.

It is the object of the invention to provide an inexpensive, easily installed device which will allow sailors to determine the type of air flow that exists on both sides of a sail while being viewed from only one side of the sail.

DESCRIPTION OF THE PREFERRED EMBODIMENTS

Figure 1:
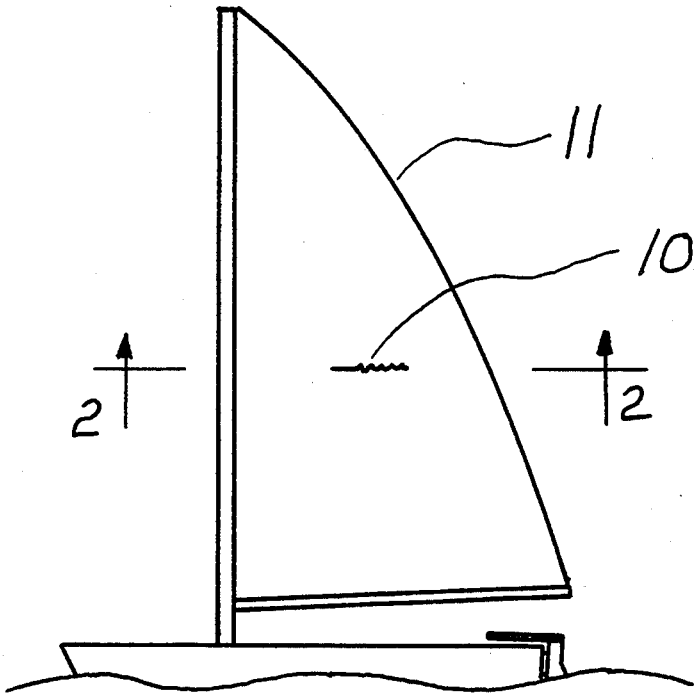
FIG. 1 is a representation of a sailboat with an air flow indicator of the present invention.

FIG. 1 illustrates a sailboat with the air flow indicator 10 of this invention affixed to its sail 11.

Figure 2:
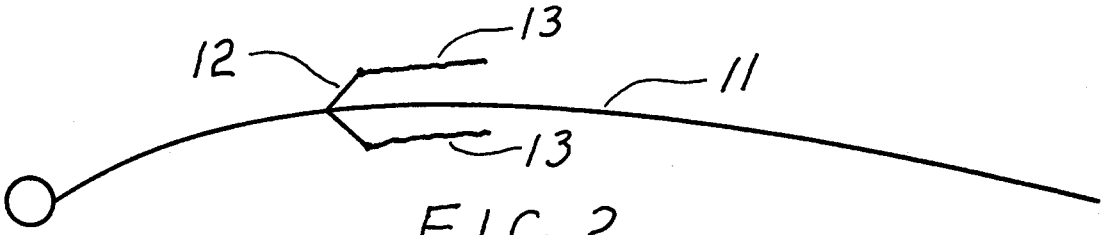
FIG. 2 is an enlarged section view taken along line 2—2 of FIG. 1 showing the position the air flow indicator of the present invention assumes with attached air flow on both sides of the sail.
Figure 3:
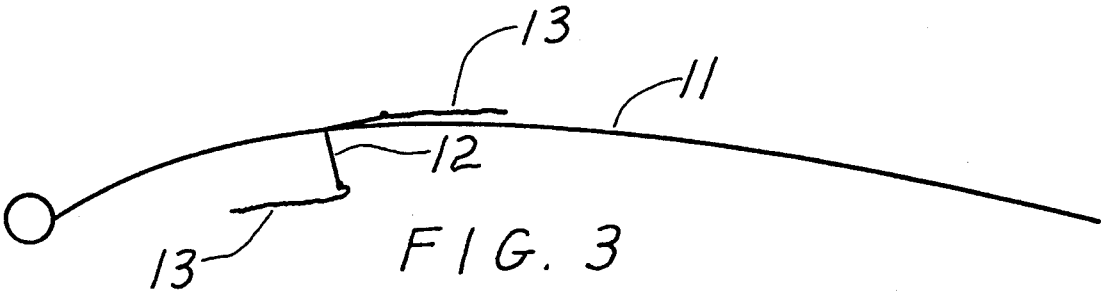
FIG. 3 is an enlarged section view taken along line 2—2 of FIG. 1 showing the position the air flow indicator of the present invention assumes with attached air flow on the leeward side of the sail and turbulent air flow on the windward side of the sail.
Figure 4:
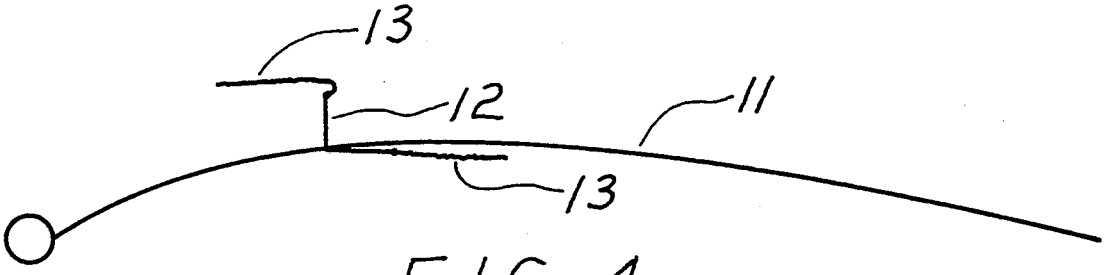
FIG. 4 is an enlarged section view taken along line 2—2 of FIG. 1 showing the position the air flow indicator of the present invention assumes with attached air flow on the windward side of the sail and turbulent air flow on the leeward side of the sail.

FIG. 2, FIG. 3 and FIG. 4 illustrate the performance of the air flow indicator 10, FIG. 1, with different air flow conditions on the sail 11. In FIG. 2, FIG. 3 and FIG. 4, the air flow indicator 10, FIG. 1, is comprised of a lever 12 which is centrally positioned through a small hole in the sail 11 and has a flexible tail 13 affixed to each end. FIG. 2 illustrates the condition of attached air flow on both sides of the sail 11 which creates equal forces on both the flexible tails 13 which in turn cause the lever 12 to assume an equal angular position with respect to the sail 11. FIG. 3 illustrates the condition of turbulent air flow on the windward side of the sail 11 and attached air flow on the leeward side of the sail 11 which creates unequal forces on the flexible tails 13 which in turn cause the lever 12 to assume an extreme angular position with respect to the sail 11. FIG. 4 illustrates the condition of attached air flow on the windward side of the sail 11 and turbulent air flow on the leeward side of the sail 11 which creates unequal forces on the flexible tails 13 which in turn cause the lever 12 to assume an extreme angular position with respect to the sail 11 which is the opposite of the position it assumed in FIG. 3. It is important to note that the air flow indicator 10, FIG. 1, assumed three distinctly different positions, as illustrated in FIG. 2, FIG. 3 and FIG. 4, depending on type of air flow, attached or turbulent, next to the sail 11 surfaces and that these three distinctly different positions could be ascertained by viewing only one side of the sail 11.

Figure 5:
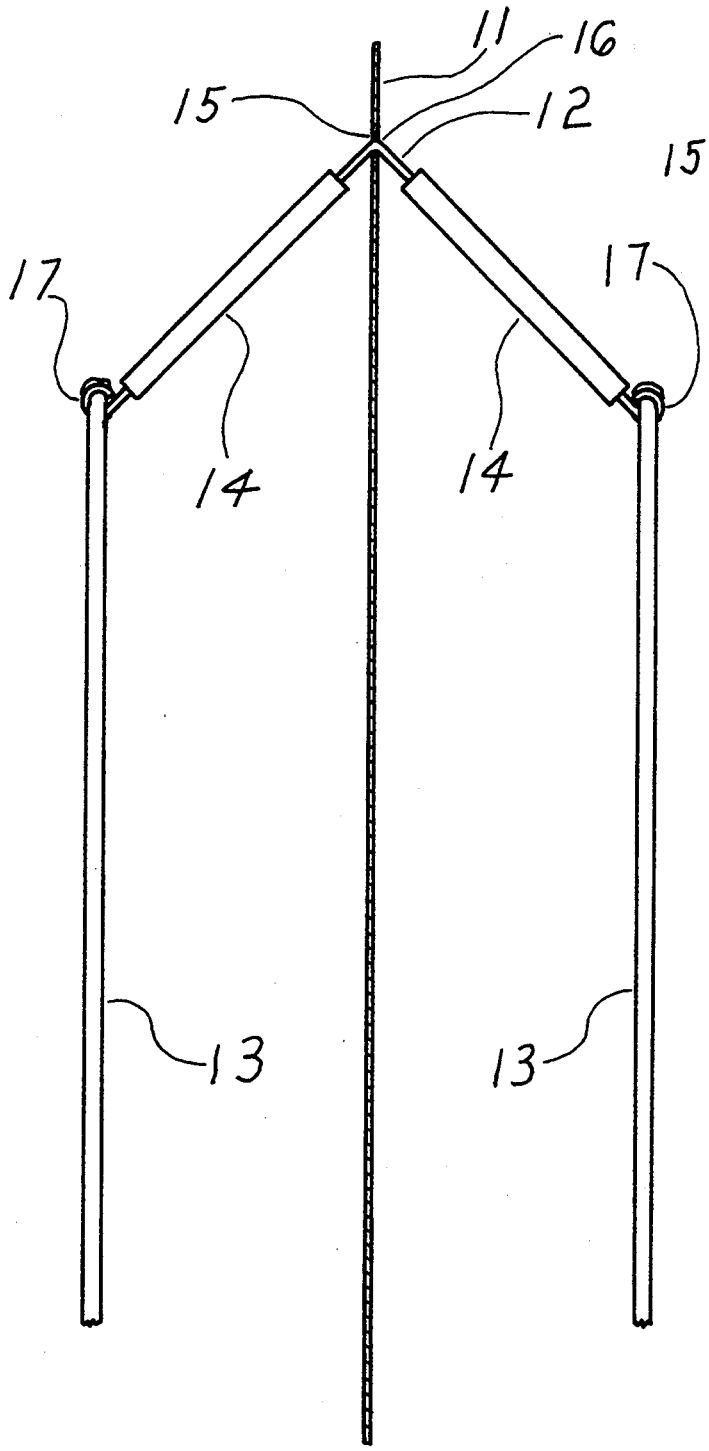
FIG. 5 is an enlarged view of the air flow indicator of the present invention as illustrated in FIG. 2.
Figure 6:
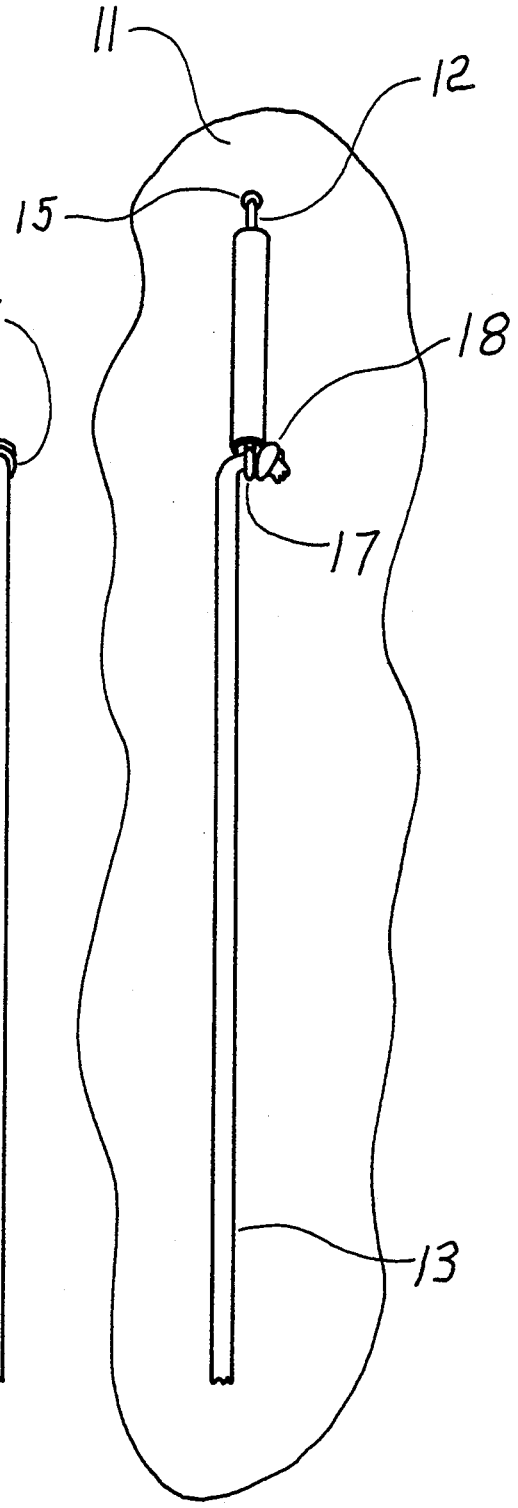
FIG. 6 is a side view of FIG. 5 without the sail being sectioned.

The enlarged views of FIG. 5 and FIG. 6 show the air flow indicator 10, FIG. 1, in sufficient detail so as to describe all the features of this preferred embodiment. The lever 12 is made from a straight piece of wire with a 90 degree bend 16 at its mid-point which acts as a pivot point with respect to the sail 11 and with an eye 17 bent into each end. It is installed through hole 15 which is large enough to allow the lever 12 to be both inserted through the sail 11 and move freely with respect to the sail 11 but smaller than sleeve 14 which helps keep the lever 12 centered and gives it greater visibility. Sleeve 14 is a close fitting plastic tube that is pushed over each eye 17 on lever 12. Enough space is left between the sleeve 14 and the sail 11 so that the lever 12 is free to pivot with respect to the sail 11. A flexible tail 13 with a knot 18 in its end is threaded through each eye 17 on the lever 12. The knot 18 keeps both the sleeve 14 and the flexible tail 13 affixed to the lever 12.

Although only one preferred embodiment of this invention has been disclosed it will be understood that various changes and modifications may be made without departing from the spirit and scope of this invention as defined in the appended claims.

I claim:

1. An air flow indicator for a sailboat sail which comprises a lever which is inserted through a hole in a sail and upon insertion and being centered with respect to the sail surfaces, will remain centered with respect to said sail surfaces and will pivot about its center point to such a degree that any force causing the part of said lever on one side of said sail to move will be transmitted to the part of said lever on the other side of said sail and cause it to also move.

2. An air flow indicator as recited in claim 1, further comprising flexible tails which are affixed to the opposite ends of said lever.

3. An air flow indicator as recited in claim 2, in which said lever is a straight wire which has a bend in the middle to form an angle that centers it between said sail surfaces and is also bent at said opposite ends to form eyes for affixing said flexible tails.

4. An air flow indicator as recited in claim 3, further comprising sleeves having an annular body with a hole therethrough receiving the straight wire portion of said lever, one on each side of said bend in said straight wire extending from close to said bend to said flexible tail for the purpose of helping to keep said lever centered between said sail surfaces without restricting the ability of said lever to pivot and to provide a more visible surface than said straight wire portion of said lever.

5. An air flow indicator as recited in claim 4, in which said bend in said straight wire forms an angle of 90 degrees.

* * * * *